US005568557A

United States Patent [19]

Ross et al.

[11] Patent Number: 5,568,557

[45] Date of Patent: Oct. 22, 1996

[54] ACTIVE VIBRATION CONTROL SYSTEM FOR AIRCRAFT

[75] Inventors: Colin F. Ross, Great Shelford; Andrew J. Langley, Welwyn, both of United Kingdom

[73] Assignee: Noise Cancellation Technologies, Inc., Linthicum, Md.

[21] Appl. No.: 283,114

[22] Filed: Jul. 29, 1994

[51] Int. Cl.[6] ..... H03B 29/00; A61F 11/06

[52] U.S. Cl. ..... 381/71; 381/94; 381/86; 381/92

[58] Field of Search ..... 381/71, 94, 73.1, 381/86, 92, 122, 169

[56] References Cited

U.S. PATENT DOCUMENTS 5,416,844 5/1995 Nakji et al. ..... 381/71
5,423,658 6/1995 Pla et al. ..... 381/71
5,426,703 6/1995 Hamabe et al. ..... 381/71

FOREIGN PATENT DOCUMENTS 6161472 7/1994 Japan ..... 381/71

OTHER PUBLICATIONS

L. E. Kinsler, et al., *Fundamentals of Acoustics,* 1982, pp. 344–372.

*Primary Examiner*—Forester W. Isen
*Assistant Examiner*—Xu Mei
*Attorney, Agent, or Firm*—Crowell & Moring

[57] ABSTRACT

An active noise and vibration reduction system for canceling noise in aircraft or other passenger carrying transportation systems which utilizes a series of seat mounted microphones and trim mounted speakers in conjunction with a digital controller with a class-D stage power amplifier and which is synched to the aircraft alternator.

13 Claims, 6 Drawing Sheets

ACTIVE VIBRATION CONTROL SYSTEM FOR AIRCRAFT

FIELD OF THE INVENTION

The invention relates to active control systems which reduce vibration inside the cabin of an aircraft, helicopter or other passenger carrying vehicle.

BACKGROUND OF THE INVENTION

The term vibration, as used in this specification, includes noise, sound and other small amplitude linear disturbances and phenomena.

It is well known how to reduce the sound in passenger cabins, PCT/GB89/00964 and PCT/GB89/02021 by the same inventor have described the use of active sound control to reduce the vibration inside a passenger cabin. Both of these applications are herein incorporated by reference. PCT/GB89/00964 describes combining the power amplifiers for driving the loudspeakers with the loudspeakers to save cable mass and to improve heat dissipation. It also describes mounting the microphones in the cabin, attached to the trim. However, many of the crucial features necessary to make an active control system work effectively in a passenger cabin were not known until the current invention was made.

PCT/GB89/02021 describes one form of control system structure that can be used for this application. All digital controllers for active sound control sample the residual sound which is a combination of the original sound and the anti-sound. This sampling process allows the analogue signals to be converted into digital representation for processing. The controller described therein uses a time base for the sampling processes which is synchronized to the rotation rate of the propeller that is making the vibration to be controlled. Using this time base has advantages for the controller as the frequencies of the vibration are directly related to the sampling rate. This makes the transformation of the information into the frequency domain simple. However, if the frequencies change significantly due to the change in the rotation rate of the propellers the model of the system (embodied in the measured transfer functions) must change. The constant need for the model to change with the sampling frequency is a disadvantage. There is also a disadvantage for controlling multiple propellers at widely varying frequencies. As multiple sample rates or interpolation between sample rates must be used.

SUMMARY OF THE INVENTION

According to the present invention an active control system for reducing the tonal vibration in the cabin of an aircraft, helicopter, or other passenger carrying vehicle comprises:

- actuators combined with individual power amplifiers which produce an additional vibration field,
- trim-mounted microphones which generate signals responsive to the sound in the cabin and insensitive to the sound between the trim and the outer skin of the vehicle,
- a controller responsive to the microphone signals which adjusts signals to the actuators so that the additional vibration field tends to reduce the cabin vibration.

In such a system the preferred embodiment incorporates the following:

- the controller receives its speed reference signal from a power alternator,
- the power amplifier contains a class-D stage which is efficient,
- the controller monitors its own performance and switches off when the monitored performance falls below a prescribed level,
- the controller detects failures of the microphones and actuators,
- thermal sensing on the loudspeaker which provides temperature information.

The actuators may be loudspeakers, and the loudspeakers may be contained in cabinets attached to the trim of the aircraft, helicopter or passenger vehicle. The cabinets may be contoured to fit into the confined space between the trim and the outer skin, and the cabinets may contain stiffening webs. The loudspeakers may have coils with a long-throw and magnets containing rare-earth elements.

Alternatively, some or all of the actuators may be shakers. Preferably these shakers would be of the inertial type with no external moving parts. Additionally, the system may have microphones mounted in the upper part of the backs of the passenger seats. These microphones are used to provide signals responsive to the internal cabin sound in addition to the trim-mounted microphones.

Preferably the controller is constructed in a modular form where additional channels can be added by adding additional electronic circuit boards. In some passenger cabins it may be suitable to use separate controllers for separate blocks of seats. Preferably the controller or controllers operate(s) on a constant sampling rate. The controller may identify the transfer function from the actuator signals to the microphone signals at least part of the time that it is reducing the vibration field. The controller may also provide a signal to a synchrophase system for setting the relative angle of the propeller or engine shafts. This signal being provided to modify the vibration field.

Accordingly, it is an object of this invention to provide an active control system for vibration in aircraft.

It is a further object of this invention to provide an aircraft noise attenuation system which utilizes speakers adjacent the skin of the aircraft.

A further object of this invention is to provide a vibration attenuation system for aircraft passenger cabins with a time base sampling process which is not synchronized to the rotation rate of the propeller.

A still further object of the present invention is to provide an active control system for reducing tonal vibration in an airborne passenger cabin.

Another object of the present invention is to provide an aircraft noise attenuation system having actuators with individual power amplifiers which produce an additional vibration field.

Another object of the present invention is to provide an aircraft noise attenuation system having trim-mounted microphones which generate signals responsive to the sound in the cabin and insensitive to the sound between the trim and outer skin of the vehicle.

Yet another object of the invention is to provide an airborne vibration attenuation system with a controller responsive to microphone signals representing the noise to be attenuated which adjusts signals to actuators within an aircraft cabin so that any additional vibration field tends to reduce the cabin vibration.

These and other objects will become apparent when reference is had to the accompanying drawings in which FIG. 1 shows a schematic of a prior art system, FIG. 2 shows a preferred embodiment of the instant device, FIG. 3 shows a block diagram of the controller used in this invention, FIG. 4 shows a diagrammatic view of a loudspeaker cabinet used in this invention, FIG. 5 shows a diagrammatic view of a microphone housing, FIG. 6 shows the digital signal circuit, FIG. 7 is a diagram of the transfer coefficients and system response, FIG. 8 shows a typical seat cross section, and FIG. 9 is a flow chart of the method of transfer function measurement.

DETAILED DESCRIPTION OF THE DRAWINGS

Figure 1:
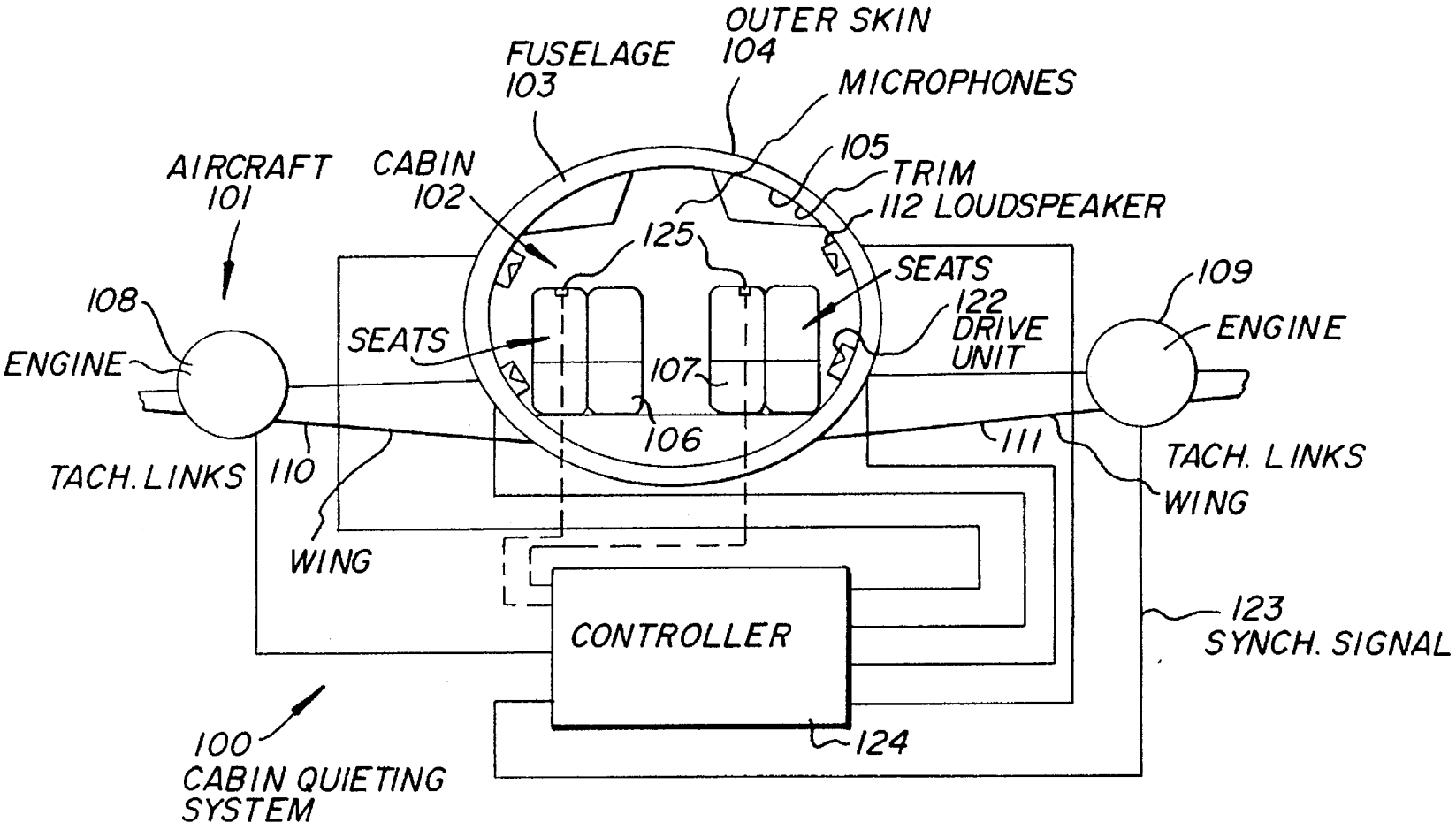
FIG. 1 PRIOR ART

FIG. 1 shows a diagrammatic representation of a cabin quieting system 100 on an aircraft 101 having a cabin 102 with a fuselage 103 having an outer skin 104 and an interior trim package 105. Seats 106, 107 are located within the fuselage 103. Aircraft 101 has a pair of engines 108, 109 mounted on wings 110 and 111, respectively. A sample synchronization signal 123 from a tachometer link with engine 109 is used by the controller 124. The loudspeaker drive units 122 are installed in the aircraft and create the anti-sound. Control microphones 125 are mounted in the cabin on seats 106 and 107 to provide residual noise signals. A second tachometer link was used with engine 108. The microphones 125 picked up the noise to be cancelled, the controller synched the counter sound to engine frequency and caused loudspeakers 112 to emit the counter sound.

Figure 2:
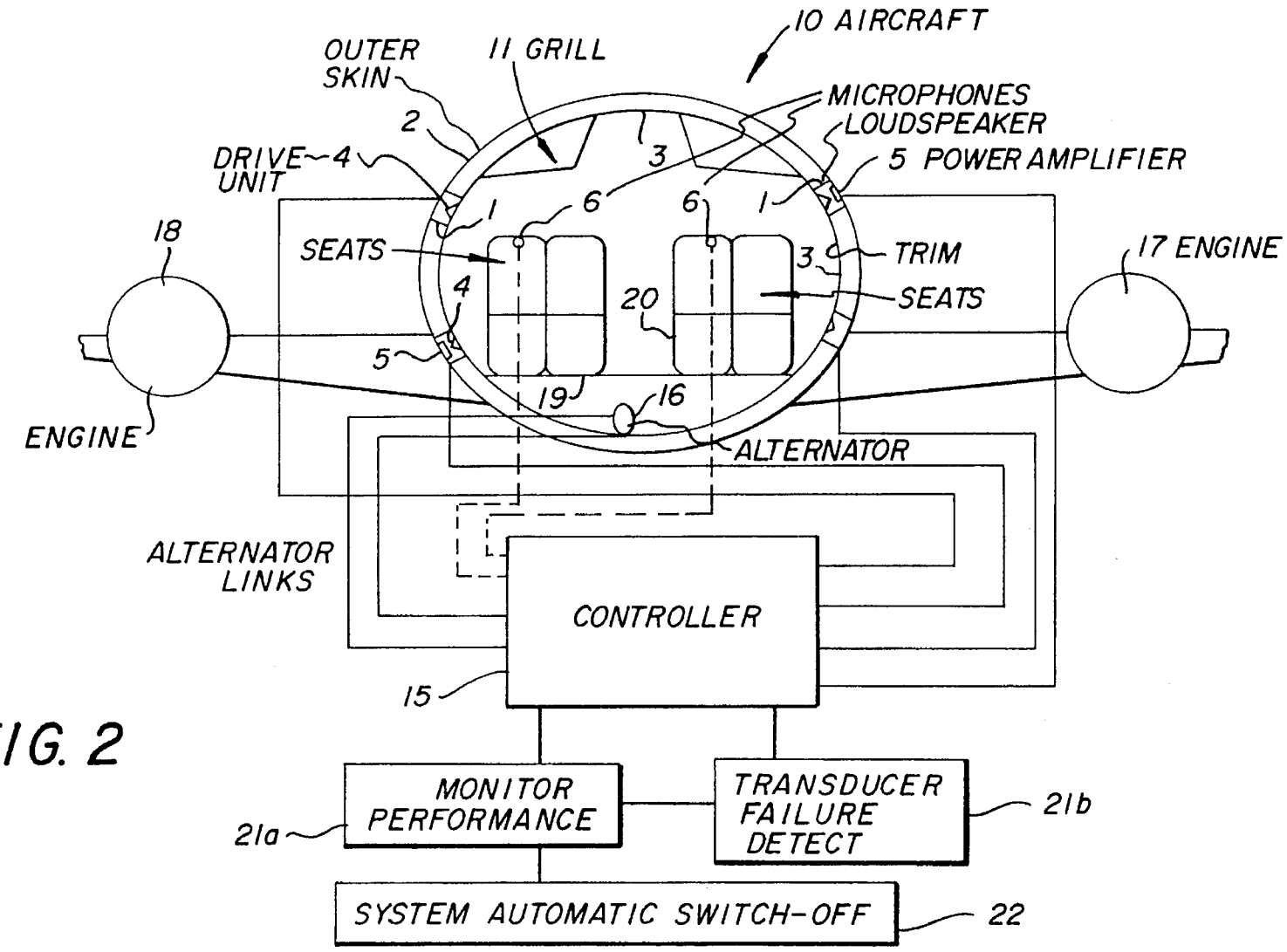
Figure 4:
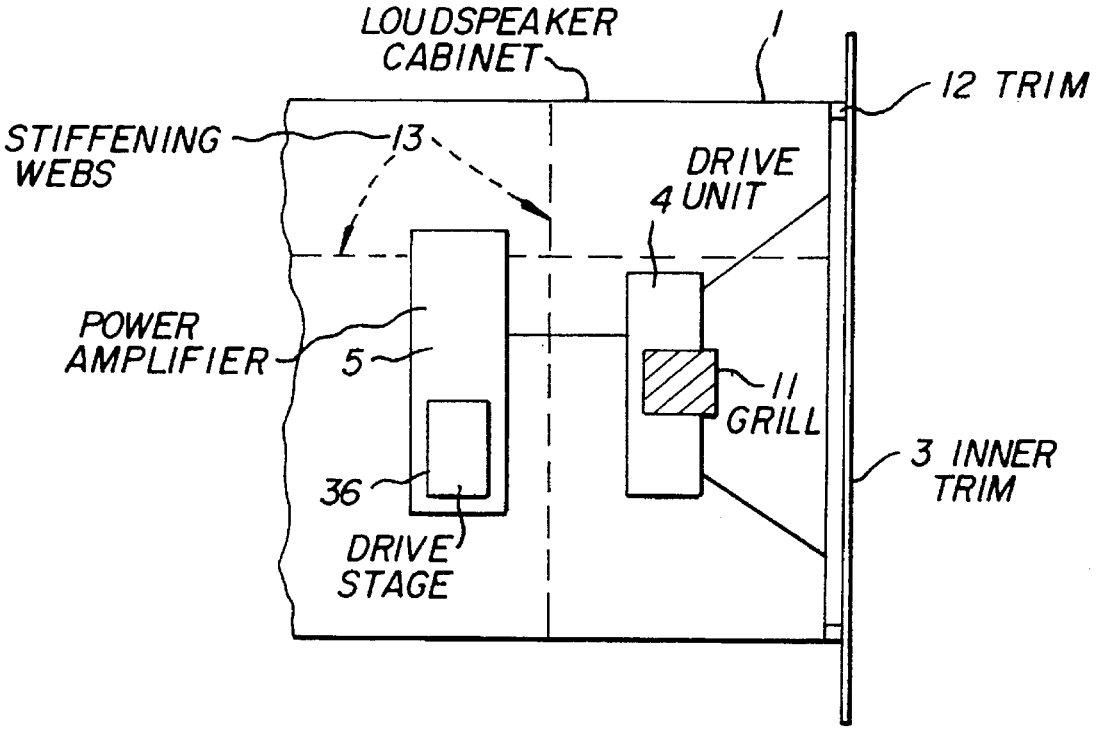

FIG. 2 shows one embodiment of the invention. Here loudspeaker cabinets 1 are mounted between the outer skin 2 of a cabin and the inner trim 3 of aircraft 10. These loudspeaker cabinets contain the loudspeaker drive units 4 and the power amplifiers 5. The loudspeaker cabinets are specially formed to fit in the space provided between the trim and the outer skin. This is necessary as there is normally a limited amount of space available for the loudspeaker cabinets and the larger the cabinet the more efficient the loudspeaker. The modification of the shape of the loudspeaker cabinet 1 is shown schematically in FIG. 4. The loudspeaker cabinets would normally be attached to the trim 12 so that they can be removed when the trim is removed. Grill 11 is used to allow the counter noise to enter the cabin.

Figure 3:
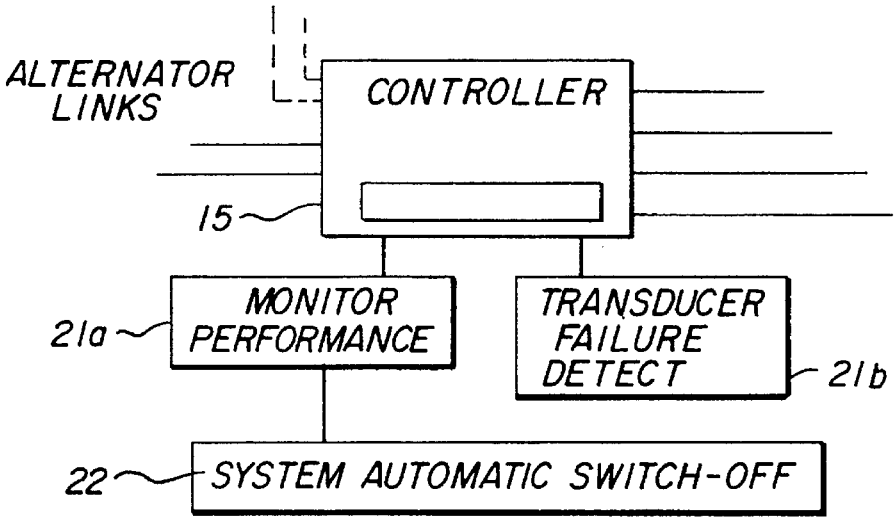

In the instant system the controller 15 is synched to the alternator 16 of the aircraft 10 and led to loudspeaker drive units 4 in the cabinets and microphones 6. There is no connection to aircraft engines 17 and 18. Microphones 6 are mounted in the upper portions of seats 19 and 20. As shown in FIG. 2 and 3, controller 15 has a portion 21*a* to monitor the performance, a portion 21*b* to detect transducer failure and a system automatic shut-off 22.

The loudspeaker cabinet provides a rear enclosure for the loudspeaker. This encloses air which provides resistance to the loudspeaker cone's movement and allows the loudspeaker to be tuned to maximize its efficiency for the frequencies to be controlled. The tuning of the loudspeaker is done by choosing the cone mass and the spider stiffness and other design parameters with reference to a loudspeaker model. A typical model can be found in "Loudspeaker Design" by L. Baranec. The motor design of the drive unit and the power amplifier design will constrain the freedom to optimize the design and these may need to be adjusted to maximize the efficiency of the loudspeaker system. There is heat generated by the loudspeaker and the power amplifier. This must be dissipated from the cabinet, and yet the space between the skin and the trim contains insulating material in aircraft. It is therefore essential that the power efficiency of the two are maximized. One effective way of achieving this is to incorporate an efficient drive stage 36 in the power amplifier 5. A class-D stage is an example of an efficient power amplifier drive stage which is often 80% efficient.

The loudspeaker cabinet must be stiff in order that there are no cabinet resonances which change the effective stiffness of the air in the enclosure. If there were resonances the efficiency of the loudspeaker would be compromised. Adding extra thickness to increase the cabinet wall stiffness necessarily gives a large mass increase. It is far more effective to provide stiffening webs so that the interior of the cabinet is more like the structure of a milk bottle crate. The stiffening webs 13 are a light way of providing stiffness to the cabinets.

The main aim of the design of the actuators is to be as efficient as possible within the space, power and weight constraints. This requires specially designed actuators. The loudspeakers have long-throw coils giving extra output and rare-earth magnets which are much lighter than conventional ferrite magnets.

Efficient packaging of the shakers is achieved by a design which has no external moving parts. It uses a long-throw coil and rare-earth magnets and produced forces as an inertial device.

In some vehicles the sound is reduced in the cabin by applying forces to the external skin instead of or as well as generating additional sound from loudspeakers. The source of the disturbance often generates vibration of the skin panels and this creates internal sound. The sound is reduced by creating opposite sound. This opposite sound is made by loudspeakers. However, the sound can also be made by applying forces to the skin. These forces produce vibration of the skin which, in turn, generates sound in the cabin. Each application demands analysis to see which is the most effective way of duplicating the sound field to be reduced. "Effective" here means the minimum number of actuators for the greatest reduction.

Figure 6:
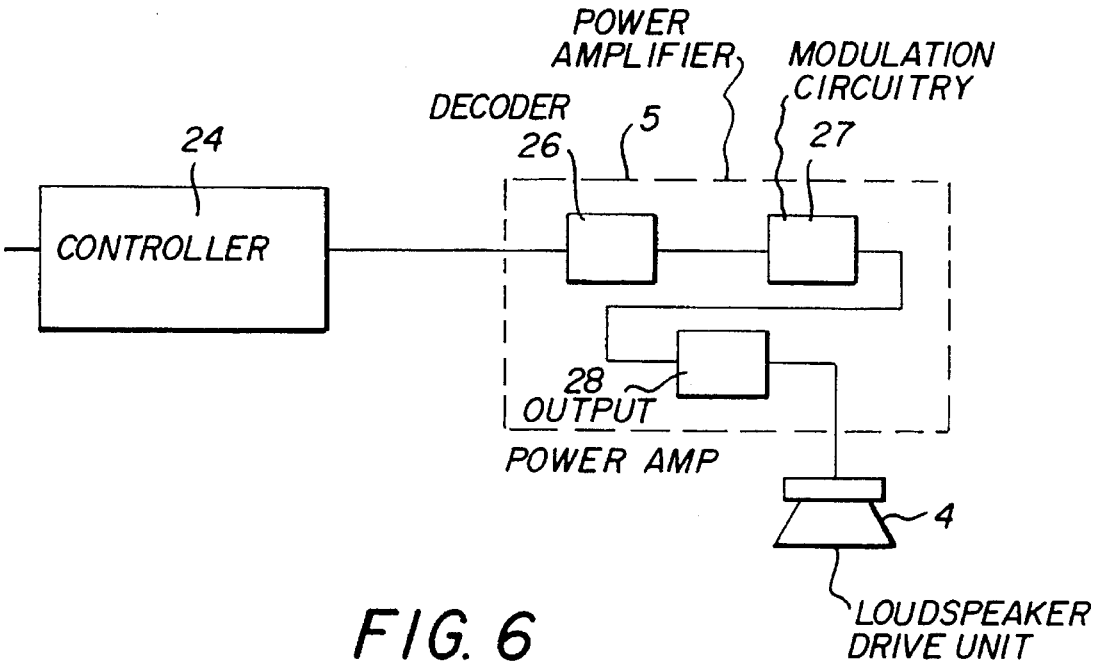

The digital controller produces a digital representation of the actuator signals. These are normally converted into analog signals and the analog signals are transmitted to the power amplifiers. In a class-D amplifier the analog signal is low-pass filtered to give a high level drive signal. A more effective way of operating is to communicate digitally between the controller and the power amplifier class-D stage. This could be an optical link so that the PWM signal can be generated in the controller and converted in the power amplifier. FIG. 6 shows a block diagram of this implementation. The digital signal for each actuator is generated by the controller 24 and transmitted as a digital signal to the power amplifier 5. In the power amplifier the digital signal is decoded in a decoder 26 and a signal from this drives the pulse width modulation circuitry 27. Finally the signal passes through the output stage 28 before being sent to the loudspeaker drive unit 4.

The internal design of the controller can be organized in a modular form so that there is, for example, a central processor circuit board which can undertake the processing for a whole range of systems. The controller is housed in a box which can take many circuit boards, five, say, and then up to 4 input/output circuit boards, each controlling 12 inputs and 12 outputs, can be added. The smallest system would have one I/O board and would control 12 inputs and 12 outputs. The next system up would have two processor boards and would control 24 inputs and 24 outputs. The next system up would have three processor boards and would control 36 inputs and 36 outputs. The largest system would have four processor boards and would control 48 inputs and 48 outputs.

One advantage of mounting the power amplifiers inside the same cabinet as the loudspeakers is that the installation is easier (there are fewer items to install) and the system is more flexible. The flexibility comes from the fact that a single size of controller (containing one processor board and two I/O boards), capable of driving 24 loudspeakers can be fitted to vehicles which require between 13 and 24 loudspeakers. The bulky power amplifiers are added with the loudspeakers as they are required for the specific aircraft. Another advantage of mounting the power amplifiers with the loudspeakers is that the heat generated by the power amplifiers is distributed around the cabin and the central controller does not require any special cooling measures.

Figure 5:
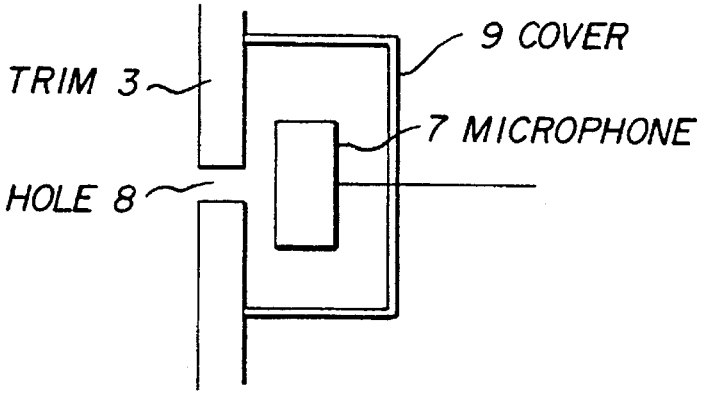

The microphones 7, shown in FIG. 5, are mounted behind the trim so as to disguise their presence. However, they are required to measure the sound inside the cabin and not the sound between the trim and the skin. This is achieved by providing a hole 8 through the trim material and by installing a cover 9 over the rear of the microphone.

The controller takes the microphone signals, which are representative of the sound in the cabin and uses these to adjust the actuator (loudspeaker or shaker) signals. The aim of this adjustment is to ensure that the sound in the cabin is reduced. The reduction can be either to minimize the average sound level or to minimize the maximum sound level. The algorithms that can be used for this and a typical controller structure are described in PCT/GB89/02021 and PCT/GB90/01850. These referenced applications are hereby incorporated by reference into this specification.

The conventional control systems described in PCT/GB89/02021 and PCT/GB89/00964 use connections to the tachometer of the aircraft. These are quite acceptable as inputs for the control system but the controller is found to be much more effective if the output from the alternator is used instead. The alternator signals are always easily available and provide a more immediate indication of the speed of the engine shafts. It is crucial to the performance of active sound control systems that there is no delay in providing the speed information. The tachometer information is normally available only once per revolution whereas the alternator, having many poles, provides the information many times per shaft revolution. In some vehicles there is no tachometer fitted, or the signal from the tachometer is not accessible. On the other hand the power from the alternator is normally available everywhere.

The controller monitors its operation and detects the failure of the transducers. The microphone failures are detected by characterizing the signals that are likely to be seen during normal operation of the system and monitoring the signals to see if they depart from the norm. If they do then the transducer is identified as having failed.

Figure 7:
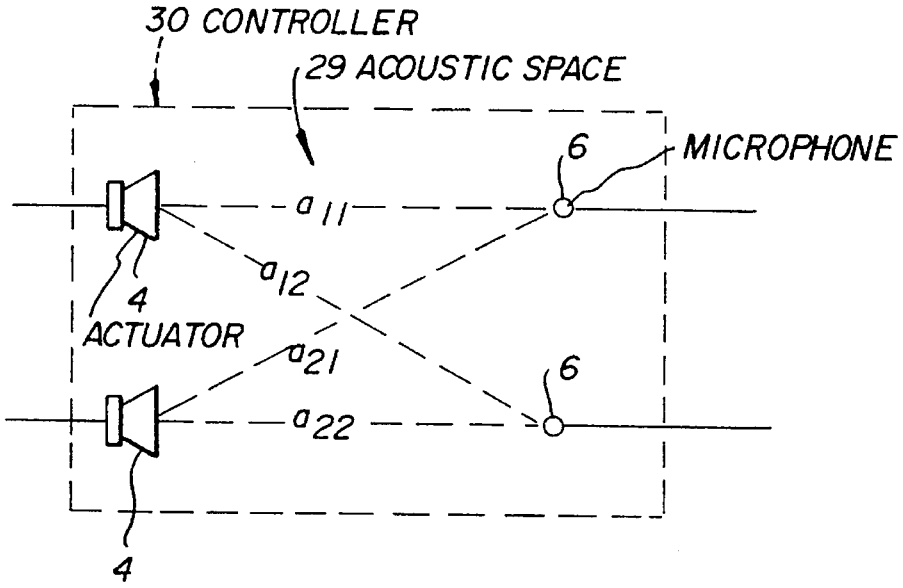
Figure 9A:
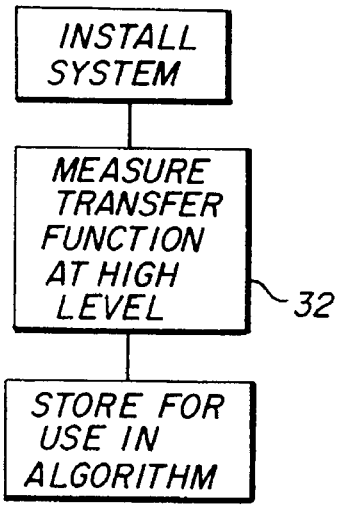
Figure 9B:
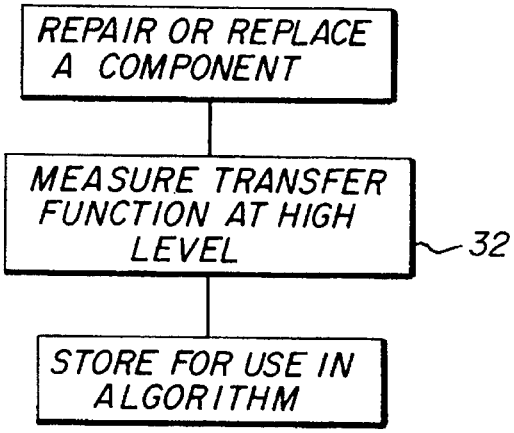
Figure 9C:
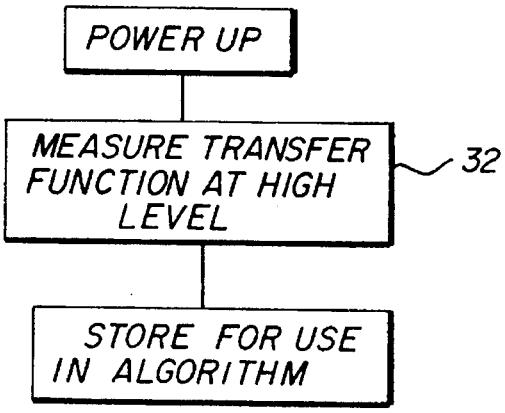
Figure 9D:
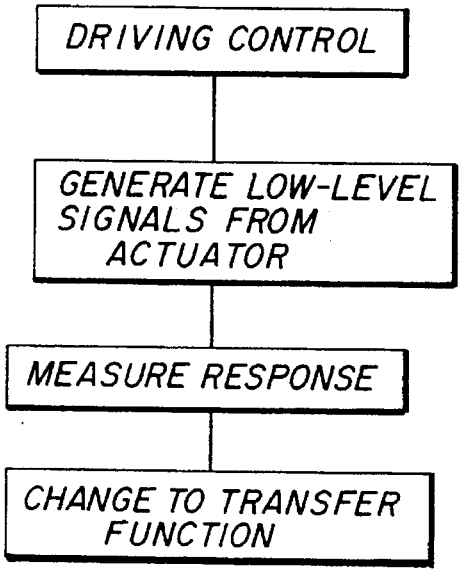
Figure 9E:
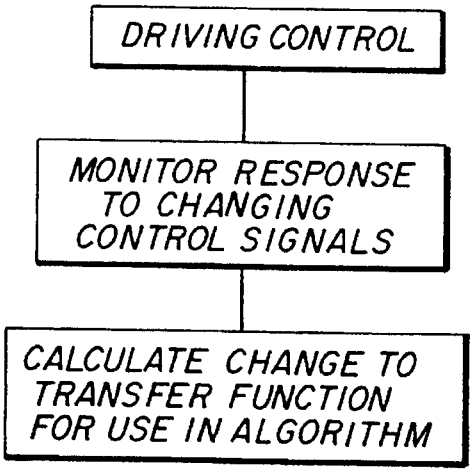

The failure of transducers can also be detected by broadcasting a low level signal from the actuators. FIG. 7 shows a controller set up 30 with two actuators 4 and two microphones 6 in an acoustic space 29. The transfer function coefficients $a_{11}$, $a_{12}$, $a_{21}$, $a_{22}$ between the actuators 4 and the microphones 6 represent the acoustic or vibration response of the properly functioning system. A signal at a low-level is generated from each actuator and the response to the signal at each microphone is measured. If this departs significantly from the stored values then this indicates a failure. This low level signal is designed to be inaudible to the passengers by selecting its spectrum appropriately. This low level signal is then detected at the microphones. The matrix of responses to the low level test signals is monitored to sense changes in a row of the matrix which indicate that the corresponding microphone has failed and changes in a column indicates that the corresponding actuator has failed.

The performance of the system is monitored in a variety of ways. Extra microphones are used to measure the performance directly. These signals are then processed to provide information on the system's performance. The system contains an internal performance model and when transducers fail the reduction in performance due to transducer failure is calculated. The system can monitor the sound field measured by all the microphones and use this to compare with stored sound fields to predict the performance.

Once the performance of the system falls below a predetermined level the controller is designed to indicate that it has failed by lighting a warning lamp and switching off the output signals. This ensures that the system will never increase the sound level in the cabin which is very desirable.

Figure 8:
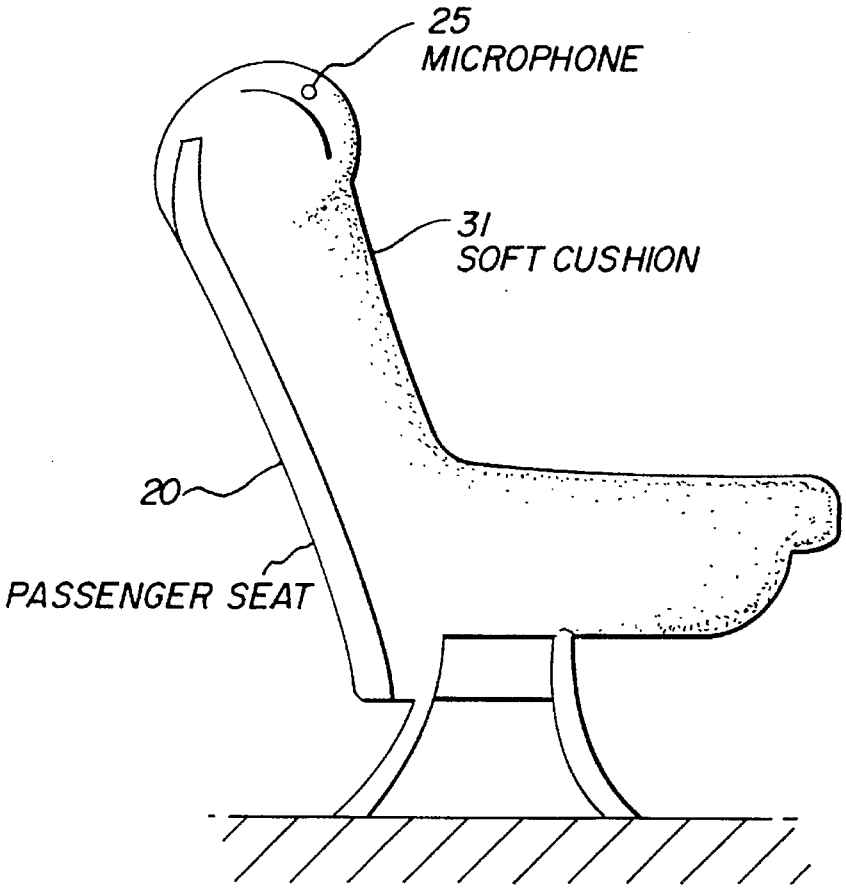

Trim-mounted microphones are convenient as they do not affect the seats in the cabin and therefore are a good choice. However, the performance of the system is maximized when the microphones are closer to the ears of the passengers. This is more effectively achieved when the microphones are positioned high up in the seat backs. In practice, it is convenient for some of the microphones to be trim-mounted and some mounted in the seats. FIG. 8 shows the microphone 6 mounted in the seat 20. The microphones are positioned high up in the seats in the soft cushion 31.

In some small aircraft cabins the cabin is long and thin. This means that the sound field in the front of the cabin is relatively unconnected to the sound field in the rear. In this case it is acceptable to have a control system which considers the interactions between the transducers in the front area and separately considers the interactions between the transducers in the rear of the cabin. The interactions between the two areas are ignored. The advantage of this is that the whole system operates with two small controllers instead of a large one. Where there are 10 loudspeakers and 10 microphones in each area the small control systems have to cope with 100 interactions each and the large control system has to cope with 400 interactions. Thus the overall system with small controllers controlling small areas of seats has the advantage of requiring less memory and computational power.

FIG. 9 shows the alternative methods of transfer function measurement. The control system algorithm described in PCT/GB89/02021 requires knowledge of the transfer function between the actuator signals and the microphone signals. This transfer function is used to generate the control system gains. The transfer function is initially measured at 32 when the system is installed in the cabin of the vehicle. This is shown in FIG. 9*a*. It may be periodically re-measured at suitable moments in the maintenance cycle as shown in FIG. 9*b*. Or it may be re-measured when the power is re-applied to the system which is shown in FIG. 9*c*. Alternatively, the system can re-measure the transfer function whilst the system is reducing the sound in the cabin. This is accomplished by generating a low level signal from each of the loudspeakers as shown in FIG. 9*d*. The response to the test signal is measured at the microphones and used to calculate the transfer function. Alternatively, the changes in the actuator signals, which happen as the system responds to the changing sound field, are measured by the microphones and the transfer function calculated by correlating the responses with the changes as shown in FIG. 9*e*.

When the transfer functions are measured they are measured with respect to the sampling frequency that the system is using at the time. The system described in PCT/GB89/02021 uses a synchronous time base. This means that the time base changes as the speed of the engine changes. The system needs to change the measured transfer function to compensate for the time base changes. This can be time-consuming and complicated. An alternative is the use of a constant sampling rate. The algorithm described in the co-pending patent application PCT/US92/05228 herein incorporated by reference provides an effective way of achieving this.

The goal of the system is to reduce the sound in the cabin. This is done with the actuators and is very effective. However, in propeller aircraft the synchrophase system is used to adjust the relative angles between the propeller shafts. By adjusting the angle, the sound field changes. In aircraft without an active control system the angle is normally chosen to reduce the sound level at the loudest seat. This angle is chosen once. The choice of the angle affects the sound field with and without the active control operating. It is advantageous to adjust this synchrophase angle during operation of the active control system as this allows the sound field to be further reduced. By providing a signal from the controller to the synchrophase this angle can be changed continuously to reduce the sound. The change in the sound field with angle is measured while the system is operating and the optimum angle selected by gradient descent.

Having described the invention attention is directed to the claims in which certain changes, substitutions and alterations would be obvious to those of ordinary skill in the art without departing from the scope thereof.

We claim:

1. An active control system for reducing the tonal vibration in the cabin of an aircraft, helicopter or other passenger carrying cabin comprising:

individual power amplifier means, actuator means combined with said individual power amplifier means and adapted to produce an additional vibration field, trim-mounted sensing means adapted to generate signals responsive to sound in the cabin and insensitive to sound between the trim and the outer skin of the vehicle, and a controller means responsive to the said sensing means signals and adapted to adjust signals to the said actuator means so that the said additional vibration field tends to reduce the said cabin vibration, said controller means characterized in that it receives its speed reference signal from a power alternator on said vehicle and that the said power amplifier means contains an efficient class-D stage and wherein the said controller means monitors its own performance and switches off when the said monitored performance falls below a prescribed level and wherein it detects failures of the said sensing means and said actuator means.

2. An active control system as claimed in claim 1 with at least a portion of said actuator means being loudspeakers, said loudspeakers contained in cabinets attached to said trim of said aircraft, helicopter or passenger cabin, and said cabinets being contoured to fit into the confined space between said trim and the outer skin, said cabinets containing stiffening webs, and said loudspeakers having coils with a long-throw and magnets containing rare-earth elements.

3. An active control system as claimed in claim 1 with at least a portion of said actuator means being shakers, said shakers being of the inertial type with no external moving parts.

4. An active control system as claimed in claim 1 with at least a portion of said actuator means being loudspeakers, said loudspeakers contained in cabinets attached to said trim of said aircraft or helicopter, and said cabinets being contoured to fit into the confined space between said trim and the fuselage, said cabinets containing stiffening webs, and said loudspeakers having coils with a long-throw and magnets containing rare-earth elements, and with shakers as at least some of the said actuators, said shakers being of the inertial type with no external moving parts.

5. An active control system as claimed in claim 1 where at least a portion of the said actuator means are loudspeakers, said loudspeakers contained in cabinets attached to the trim of said aircraft or helicopter, and said cabinets being contoured to fit into the confined space between said trim and the fuselage, and said cabinets containing stiffening webs, said loudspeakers having coils with a long-throw and magnets containing rare-earth elements, and with shakers as at least some of the said actuators, said shakers being of the inertial type with no external moving parts.

6. An active control system as claimed in claim 1 and including second sensing means mounted in the upper part of the backs of the cabin passenger seats, these said second sensing means being used to provide additional signals to said controller means responsive to the internal cabin sound.

7. An active control system as claimed in claim 1 wherein said controller means is built in a modular form where the additional channels can be added by adding additional electronic circuit boards.

8. An active control system as claimed in claim 1 and having additional controller means which are used for separate blocks of passenger seats.

9. An active control system as claimed in claim 1 wherein said controller means operates on a constant sampling rate.

10. An active control system as claimed in claim 9 wherein said controller means identifies the transfer function from the said actuator signals to the said sensing means signals at least part of the time that it is reducing said vibration field.

11. An active control system as claimed in claim 9 wherein the system provides a signal to a synchrophase system for setting the relative angle of the propeller or engine shafts which is used to modify further said vibration field.

12. An active control system as claimed in claim 1 wherein said controller means has a digital link or PWM link from it to said individual power amplifier means.

13. An active control system as claimed in claim 1 wherein said actuator means are loudspeakers having drive units and being cabinets and in which the loudspeaker drive unit and the loudspeaker cabinet volume are tuned to provide the highest efficiency of output within the constraints imposed by a power amplifier and said loudspeaker drive unit motor.

* * * * *